US011933539B2

(12) United States Patent
Xu et al.

(10) Patent No.: US 11,933,539 B2
(45) Date of Patent: Mar. 19, 2024

(54) CRYOGENIC AIR SEPARATION UNIT WITH ARGON CONDENSER VAPOR RECYCLE

(71) Applicants: Zhengrong Xu, East Amherst, NY (US); Neil M. Prosser, Lockport, NY (US)

(72) Inventors: Zhengrong Xu, East Amherst, NY (US); Neil M. Prosser, Lockport, NY (US)

(73) Assignee: Praxair Technology, Inc., Danbury, CT (US)

( * ) Notice: Subject to any disclaimer, the term of this patent is extended or adjusted under 35 U.S.C. 154(b) by 273 days.

(21) Appl. No.: 17/399,742

(22) Filed: Aug. 11, 2021

(65) Prior Publication Data

US 2023/0052938 A1 Feb. 16, 2023

(51) Int. Cl.
*F25J 3/04* (2006.01)
*F25J 3/02* (2006.01)

(52) U.S. Cl.
CPC ..... *F25J 3/0423* (2013.01); *F25J 3/0285* (2013.01); *F25J 3/04084* (2013.01);
(Continued)

(58) Field of Classification Search
CPC ..... F25J 3/0423; F25J 3/0285; F25J 3/04084; F25J 3/0409; F25J 3/04303; F25J 3/04412; F25J 3/04678; F25J 3/04884; F25J 2205/60; F25J 2200/20; F25J 2210/04; F25J 2215/54; F25J 2240/46; F25J 2245/02;
(Continued)

(56) References Cited

U.S. PATENT DOCUMENTS 3,264,830 A * 8/1966 Smith ..... F25J 3/04787 62/651
4,848,996 A * 7/1989 Thorogood ..... F25J 3/0443 62/652

(Continued)

FOREIGN PATENT DOCUMENTS

DE 3814187 A1 11/1989
DE 20319823 U1 4/2004
JP S61276680 A * 12/1986

OTHER PUBLICATIONS

Anonymous Ed, Darl Kuhn: "An Integrated Heat Pump Cycle for Enhanced Argon Recovery", ip.com, ip.com Inc., West Henrietta, NY, US, Sep. 12, 2003, XP013012743, ISSN: 1533-0001, last line, paragraph 3; Figure.

(Continued)

*Primary Examiner* — John F Pettitt, III
*Assistant Examiner* — Ibrahim A. Michael Adeniji
(74) *Attorney, Agent, or Firm* — Robert J. Hampsch

(57) ABSTRACT

A system and method for improving the performance of an oxygen, nitrogen, and argon producing air separation unit configured to produce a gaseous nitrogen product stream is provided. By recycling the argon condenser boil-off vapor stream to the main air compression train, the argon recovery and oxygen recovery while maintaining the production level of a medium or high pressure gaseous nitrogen product stream. In addition, some operational cost savings in terms of lower power costs can also be realized compared to some prior art oxygen, nitrogen, and argon producing air separation units.

14 Claims, 2 Drawing Sheets

(52) U.S. Cl.
CPC ..... *F25J 3/0409* (2013.01); *F25J 3/04303* (2013.01); *F25J 3/04412* (2013.01); *F25J 3/04678* (2013.01); *F25J 3/04884* (2013.01); *F25J 2205/60* (2013.01)

(58) Field of Classification Search
CPC .. F25J 2245/50; F25J 2250/02; F25J 2250/10; F25J 2250/20; F25J 3/04672; F25J 2215/58; F25J 2245/90
See application file for complete search history.

(56) References Cited

U.S. PATENT DOCUMENTS 4,883,519 A * 11/1989 Agrawa ..... F25J 3/04284 62/652
5,129,932 A * 7/1992 Agrawal ..... F25J 3/04678 62/652
5,692,396 A 12/1997 Rathbone
5,701,763 A * 12/1997 Howard ..... B01D 53/04 95/41
2002/0029587 A1* 3/2002 Pompl ..... F25J 3/04672 62/649
2006/0272353 A1* 12/2006 Prasad ..... F25J 3/04727 62/646
2016/0003538 A1* 1/2016 Falta ..... F25J 3/04678 62/644
2019/0072325 A1* 3/2019 Shelat ..... F25J 3/0409
2019/0331418 A1* 10/2019 Prosser ..... F25J 3/04181
2021/0372698 A1* 12/2021 Xu ..... F25J 3/04048

OTHER PUBLICATIONS

Harry Cheung: "Moderate-pressure cryogenic air separation process", Gas Separation & Purification, vol. 5, No. 1, Mar. 1, 1991, pp. 25-28, XP055609506, ISSN: 0950-4214, DOI: 10.1016/0950-4214(91) 80045-7 p. 26, col. 2, Paragraph 2, Figure 2.

* cited by examiner

CRYOGENIC AIR SEPARATION UNIT WITH ARGON CONDENSER VAPOR RECYCLE

TECHNICAL FIELD

The present invention relates to a cryogenic air separation unit, and more particularly, to a system and method for enhancing argon recovery and oxygen recovery in an oxygen, argon and nitrogen producing air separation unit by recycling a portion of the argon condenser vapor.

BACKGROUND

Among the various cryogenic air separation cycles used in an oxygen, nitrogen, and argon producing air separation units, it is often beneficial to take a medium to high pressure, gaseous nitrogen (GAN) stream from the higher pressure column as one of the key products in the product slate. However, the amount of the pressurized GAN stream available to be taken as a product stream is often limited because the extraction of the GAN from the higher pressure column adversely impacts the recovery of other products, namely the argon recovery and, to some extent, the oxygen recovery. The product recovery penalties associated with taking the medium to high pressure GAN stream are most sever in air separation cycles that direct some or all of the turbine air refrigeration stream to the lower pressure column rather than the higher pressure column of the distillation column system in the air separation unit.

What is needed, therefore is an air separation system and method that mitigates the penalties to the argon recovery and oxygen recovery when taking a moderate to high pressure GAN stream as part of the product slate.

SUMMARY OF THE INVENTION

The present invention may be characterized as an oxygen, nitrogen, and argon producing air separation unit configured to receive an incoming feed air stream and produce one or more oxygen product streams, one or more nitrogen product streams, and an argon stream. Inventive aspects and features of the oxygen, nitrogen, and argon producing air separation unit comprise a first portion of the boil-off stream from the argon condensing arrangement is returned to the lower pressure column while a second portion of the boil-off stream from the argon condensing arrangement is recycled and mixed or blended with the incoming feed air wherein the flow of the second portion of the boil-off stream from the argon condensing arrangement is between about 5.0% and about 12.0% of the flow of the incoming feed air stream.

The present invention may also be characterized as a method for increasing the argon recovery in an oxygen, nitrogen, and argon producing air separation unit, the method comprising the steps of: (a) directing a first portion of the boil-off stream from the argon condensing arrangement to the lower pressure column of the distillation column system; (b) recycling a second portion of the boil-off stream from the argon condensing arrangement to the main air compression train; (c) mixing or blending the second portion of the boil-off stream from the argon condensing arrangement with the incoming feed air stream. The recycled second portion of the boil-off stream from the argon condensing arrangement is preferably between about 5.0% and about 12.0% of the flow of the incoming feed air stream.

By recycling the second portion of the boil-off vapor stream from the argon condensing arrangement, the argon recovery from the air separation unit is significantly enhanced while maintaining the production level of a medium or high pressure gaseous nitrogen product stream. Argon recoveries in excess of 70%, and more preferably in excess of 75% are attainable with little or no additional power costs. In addition, the oxygen recovery from the air separation unit is moderately improved to greater than 97%, and more preferably to greater than 98% also while maintaining the production level of the gaseous nitrogen product stream.

The argon condensing arrangement may be a single stage argon condensing heat exchanger or a two-stage argon condensing arrangement, as generally shown in the Figures. In the two-stage argon condensing arrangement, the second part of the boil-off stream would preferably be the boil-off stream from the first stage of the argon condensing arrangement while in the single stage argon condenser, the boil-off stream is split into two portions. In some embodiments, the boil-off vapor stream from the argon condensing arrangement is the vaporized portion of the oxygen containing condensing medium. The oxygen containing condensing medium is preferably a subcooled kettle stream taken from the bottom of the higher pressure column. Alternatively, the oxygen containing condensing medium for the argon condensing arrangement may be a portion of the high pressure liquid oxygen product stream or the pumped liquid oxygen stream, or even a synthetic kettle stream made up of a mixture of liquid oxygen and liquid nitrogen streams from within the air separation unit. The argon condensing heat exchanger can be a thermosyphon type condenser (e.g. pool boiling condenser) or once-through type condenser design.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawings in which:

DETAILED DESCRIPTION

Turning now to the Figures, there is shown simplified illustrations of a cryogenic air separation unit 10, 11. In a broad sense, the cryogenic air separation unit 10, 11 includes a main feed air compression train, a turbine air refrigeration circuit, one or more booster air circuits, a heat exchanger arrangement, and a distillation column system. As used herein, the main feed air compression train, the turbine air circuit, and any booster air circuit, collectively comprise a 'warm-end' air compression circuit. Similarly, the heat exchanger arrangement, portions of the turbine based refrigeration circuit and portions of the distillation column system are referred to as the 'cold-end' equipment that are typically housed in one or more insulated cold boxes.

Figure 1:
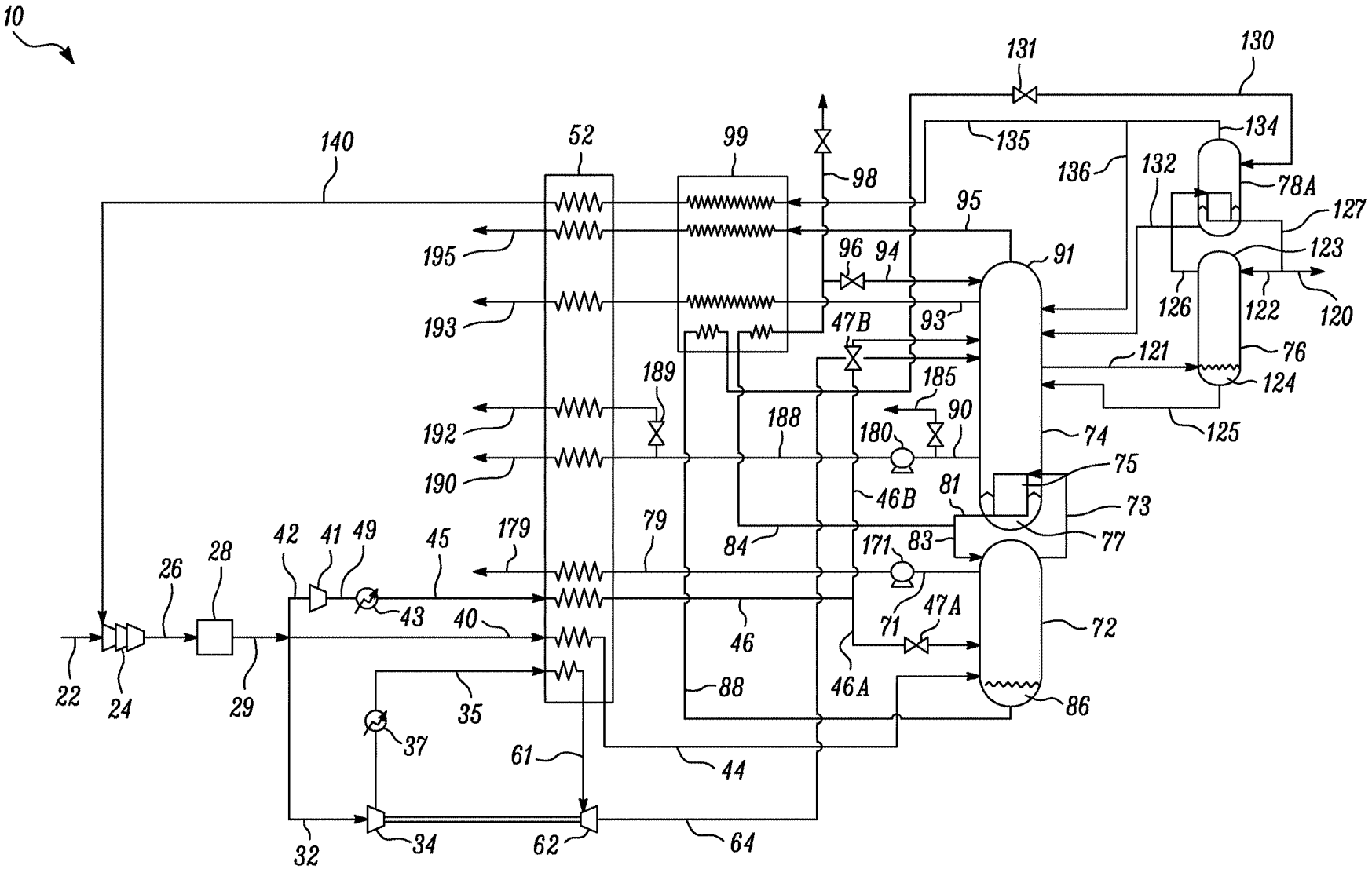
FIG. 1 is a partial schematic representation of a cryogenic air separation unit having an argon condenser vapor recycle in accordance with one embodiment of the present systems and methods.
Figure 2:
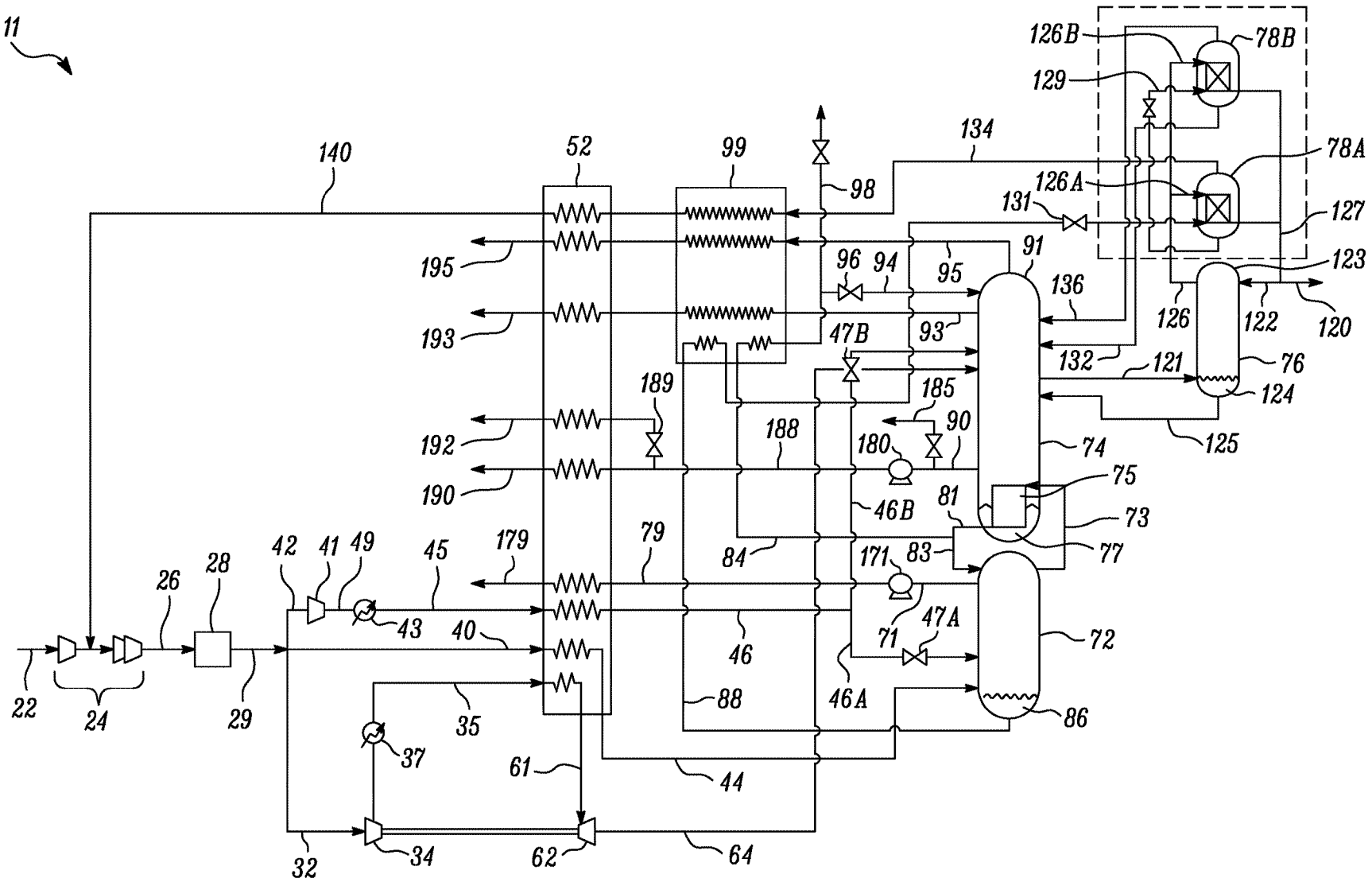
FIG. 2 is a schematic representation of yet another embodiment of a cryogenic air separation unit employing the present argon condenser vapor recycle features.

In the main feed air compression train shown in FIGS. 1 and 2, the incoming feed air 22 is drawn through an air suction filter house and compressed in a multi-stage, intercooled main air compressor arrangement 24 to a pressure that can be between about 5 bar(a) and about 15 bar(a). This main air compressor arrangement 24 may include integrally geared compressor stages or a direct drive compressor stages. The compressed air stream exiting the main air compressor arrangement 24 is typically fed to an aftercooler with integral demister to remove the free moisture in the stream. The heat of compression from the final stages of compression for the main air compressor arrangement 24 is typically removed in an aftercooler and an integral demister to remove the free moisture in the stream.

The cool, dry compressed air feed 26 is purified in a pre-purification unit 28 to remove high boiling contaminants from the cool, dry compressed air feed 26. The pre-purification unit 28, as is well known in the art, typically contains a plurality of layers of alumina and/or molecular sieve operating in accordance with a temperature and/or pressure swing adsorption cycle in which moisture and other impurities, such as carbon dioxide, water vapor and hydrocarbons, are adsorbed. While one of the beds is used for pre-purification of the cool, dry compressed air feed while the other bed is regenerated, preferably with a portion of the waste nitrogen from the air separation unit. The two beds switch service periodically. Particulates may also be removed from the compressed, pre-purified feed air in a dust filter disposed downstream of the pre-purification unit 28 to produce the compressed, purified feed air stream 29.

As described in more detail below, the compressed, purified feed air stream 29 is separated into oxygen-rich, nitrogen-rich, and argon-rich fractions in a plurality of distillation columns including a higher pressure column 72, a lower pressure column 74, and an argon column arrangement, which may include the illustrated superstaged argon column 76, and one or more argon condensers 78A, 78B. The argon column arrangement is preferably coupled to the lower pressure column 74 and arranged or configured with to produce a crude argon stream 120. The crude argon stream 120 may be further refined using various argon refining options, including but not limited to a catalytic deoxo, liquid or gas phase argon adsorption purification, a high ratio column arrangement, or any combination thereof, may be included in or added to the integrated with the air separation unit, and more particularly integrated with other portions of the distillation column system.

Prior to such distillation however, the compressed, pre-purified feed air stream 29 may be split into a plurality of feed air streams, including a main air stream 40, a boiler air stream 42 and a turbine air stream 32 described in more detail below. The boiler air stream 42 is further compressed and cooled to temperatures required for fractional distillation in the distillation columns. Cooling the boiler air stream 42 to cryogenic temperatures of between about 96 Kelvin and 100 Kelvin is preferably accomplished by way of indirect heat exchange in a primary or main heat exchanger 52 with the warming streams which include the one or more oxygen, nitrogen and/or argon streams from the distillation column system. Refrigeration for the cryogenic air separation unit 10 is also typically generated by the turbine air circuit.

In the illustrated embodiments, the compressed and purified feed air stream 29 is divided into a first stream 42, and a second stream 32. First stream 42, often referred to as the boiler air stream, is generally about 25% to 40% of the compressed and purified feed air stream and is yet further compressed within a single or multi-stage intercooled compressor 41 and aftercooler 43. As with the main air compressor arrangement, this boiler air stream compressor 41 may be motor driven or may be a booster compressor driven by a turbine/expander. This boiler air stream compressor 41 further compresses the first boiler air stream 42 to a targeted pressure generally between about 25 bar(a) and about 70 bar(a) to produce a further compressed boiler air stream 49. The further compressed boiler air stream 49 is directed or introduced into aftercooler 43 to produce the compressed boiler air stream 45. Compressed boiler air stream 45 is then directed to main heat exchanger 52 where it is used to boil a liquid oxygen stream 188 and liquid nitrogen stream via indirect heat exchange to produce a high pressure gaseous oxygen product stream 190 and/or medium pressure oxygen product stream 192. The compressed and cooled boiler air stream 45 is may be subsequently divided into air streams 46A and 46B which are then partially expanded in expansion valve(s) 47A and 47B and for introduction into the higher pressure column 72 and lower pressure column 74, respectively. The target pressure of the compressed boiler air stream 45 is generally dictated by the product requirements for the high pressure gaseous oxygen product stream 190. The temperature of the cooled and compressed boiler air stream 46 exiting the main heat exchanger 52 is preferably between about 96 Kelvin and 100 Kelvin which represents a cold-end temperature of the main heat exchanger 52.

As illustrated, second stream 32, often referred to as the turbine air stream 32, is generally about 4% to 10% of the compressed and purified feed air stream 29 and is optionally further compressed in one or more turbine air compressors 34, cooled in aftercooler 37 and directed as stream 35 to the main heat exchanger 52 where it is partially cooled prior to being directed to the expander 60, as described below. The target pressure of the further compressed turbine air stream 35 is preferably between about 20 bar(a) and about 60 bar(a).

The main heat exchanger 52 is preferably a brazed aluminum plate-fin type heat exchanger. Such heat exchangers are advantageous due to their compact design, high heat transfer rates and their ability to process multiple streams. They are manufactured as fully brazed and welded pressure vessels. For small air separation units, a heat exchanger comprising a single core may be sufficient whereas for larger air separation units handling higher flows, the main heat exchanger may be constructed from several cores connected in parallel or series.

Turbine based refrigeration circuits are often referred to as either a lower column turbine (LCT) arrangement or an upper column turbine (UCT) arrangement which are used to provide refrigeration to a two-column or three column distillation system. In the UCT arrangements shown in FIGS. 1 and 2, the compressed turbine air stream 35 is preferably at a pressure in the range from between about 20 bar(a) to about 60 bar(a). The compressed turbine air stream 35 is directed or introduced into main heat exchanger 52 where it is partially cooled to a temperature in a range of between about 130 Kelvin and about 220 Kelvin to form a partially cooled, compressed turbine air stream 61 that is subsequently introduced into a turboexpander 62 to produce an exhaust stream 64 that is introduced into the lower pressure column 72 of distillation column system. In some embodiments, turboexpander 62 may be operatively coupled to and drive the turbine air compressor 34, either directly or by appropriate gearing.

In all contemplated embodiments, the aforementioned components of the feed air streams, namely oxygen, nitrogen, and argon are separated within the distillation column system that includes a higher pressure column 72 and a lower pressure column 74, and an argon column 76 using a well-known process of fractional distillation. In the fractional distillation of air, the higher pressure column 72 typically operates at a pressure in the range from between about 20 bar(a) and about 60 bar(a) whereas the lower pressure column 74 typically operates at pressures between about 1.1 bar(a) and about 1.5 bar(a).

The higher pressure column 72 and the lower pressure column 74 are preferably linked in a heat transfer relationship such that a nitrogen-rich vapor column overhead, extracted from the top of higher pressure column 72 as a stream 73, is condensed within a condenser-reboiler 75 located in the base of lower pressure column 74 against boiling an oxygen-rich liquid column bottoms 77. The boiling of oxygen-rich liquid column bottoms 77 initiates the formation of an ascending vapor phase within lower pressure column 74. The condensate from the condenser-reboiler 75 is a liquid nitrogen containing stream 81 that is that divided into reflux stream 83 and clean shelf nitrogen stream 84. Reflux stream 83 is returned to or released into the higher pressure column 72 to initiate the formation of descending liquid phases in such higher pressure column. A portion of the clean shelf nitrogen stream 84 is directed as reflux to the lower pressure column 74 to initiate the formation of descending liquid phases therein and a second gaseous nitrogen stream 71 is also taken from the upper section of the higher pressure column 72. The second gaseous nitrogen product stream 71 is then pumped in pump 171 and the resulting pumped gaseous nitrogen stream 79 is warmed in heat exchanger 52 to produce the medium pressure gaseous nitrogen product stream 179.

In the illustrated embodiments, compressed boiler air stream 46A and a fully cooled main air stream 44 are introduced into the higher pressure column 72. In such embodiments, the fully cooled main air stream 44 is a medium pressure air stream at a pressure of between about 5 bar(a) and about 9 bar(a) that is discharged from the main heat exchanger 52 at or near the cold-end temperature. Within the higher pressure column 72, there is a mass transfer occurring between an ascending vapor phase with a descending liquid phase that is initiated by reflux stream 83 to produce a crude liquid oxygen column bottoms 86, also known as kettle liquid and the nitrogen-rich column overhead 87. A plurality of mass transfer contacting elements are used to facilitate the mass transfer between the ascending vapor and descending liquid in the higher pressure column 72.

Lower pressure column 74 is also provided with a plurality of mass transfer contacting elements such as structured packing or trays. As stated previously, the distillation process produces an oxygen-rich liquid column bottoms 77 and a nitrogen-rich vapor column overhead 91 that is extracted as a nitrogen product stream 95. An oxygen-rich liquid stream 90 is extracted from a lower section of the lower pressure column 74 and preferably pumped via pump 180 to a higher pressure as pumped liquid oxygen stream 188 and directed to the main heat exchanger 52 where it is vaporized to produce a high pressure oxygen vapor product stream 190. A portion of the pumped liquid oxygen stream 188 may be expanded in valve 189 and subsequently vaporized in the main heat exchanger 52 to produce a medium pressure oxygen vapor product stream 192. Also, a portion of the oxygen-rich liquid stream 90 may optionally be taken as a high pressure liquid oxygen product stream 185.

Additionally, a waste nitrogen stream 93 is often extracted from the lower pressure column 74 to control the purity of nitrogen product stream 95. Both the nitrogen product stream 95 and nitrogen waste stream 93 are passed through subcooling unit 99 designed to subcool the kettle liquid stream 88 and subcool the clean shelf nitrogen stream 84. A portion of the subcooled clean shelf nitrogen stream 84 may optionally be taken as a liquid product stream 98 and the remaining portion, shown as reflux stream 94, is introduced into lower pressure column 74 after passing through expansion valve 96. After partial warming by passage through subcooling unit 99, the nitrogen product stream 95 and nitrogen waste stream 93 are fully warmed within main heat exchanger 52 to produce a warmed nitrogen product stream 195 and a warmed nitrogen waste stream 193. Although not shown, the nitrogen waste stream 193 may be used to regenerate the adsorbents within the pre-purification unit 28.

The argon superstaged column 76 receives an argon and oxygen containing vapor feed 121 from the lower pressure column 74 and down-flowing argon rich reflux 122 received from an argon condenser 78A situated above the superstaged argon column 76. The superstaged argon column 76 typically has between about 180 and 240 stages of separation and serves to rectify the argon and oxygen containing vapor feed 121 by separating argon from the oxygen into an argon enriched overhead vapor 123 and an oxygen-rich liquid bottoms 124 that is returned to the lower pressure column as stream 125. All or a portion of resulting argon-rich vapor overhead 123 is preferably directed as argon-rich vapor stream 126 to the argon condenser 78A where it is condensed against an oxygen containing condensing medium 130. Most of the resulting condensate stream 127 taken from the argon condenser 78 is returned to the superstaged argon column 76 as argon reflux stream 122 while a smaller portion is taken as a crude liquid argon stream 120. Although not shown, the crude liquid argon stream 120 is typically directed to a high ratio argon column where it is rectified to form liquid argon bottoms from which a liquid argon product stream may be taken.

Within the argon condenser 78A, the oxygen containing condensing medium 130 provides the cooling duty necessary to condense the argon-rich vapor stream 126 taken from the overhead 123 of the argon superstaged column 76. In the illustrated embodiments, a stream 88 of the crude liquid oxygen column bottoms 86 or kettle liquid is withdrawn from the higher pressure column 72, subcooled in subcooling unit 99 and expanded in an expansion valve 131 to the pressure at or near that of the argon condenser 78A as the oxygen containing condensing medium 130. As indicated above, a first large portion of the condensed argon stream 127 is returned to the argon column 76 as reflux stream 122 while a second smaller portion of the condensed argon stream 177 is taken as a crude argon stream 120. Any excess liquid from the condensing medium is returned to the lower pressure column 74 as stream 132 while the boil-off vapor stream 134 from the argon condenser 78A is recycled. A first part of the boil-off vapor stream from the argon condenser is also returned to the lower pressure column 74 as stream 136 while a second part of the boil-off vapor stream from the argon condenser is a recycle stream 135 that is warmed in subcooler 99 and main heat exchanger 52 and directed to the main air compressor 24 as warm recycle stream 140.

By recycling the second part of the boil-off vapor stream from the argon condenser, the air separation unit may be configured for significantly increasing the argon recovery and moderately increasing the oxygen recovery while maintaining or increasing the production level of the medium or high pressure gaseous nitrogen product stream. Argon recoveries in excess of 70% and oxygen recoveries in excess of 97% can be achieved with little or no additional power costs. In some cases, the power requirements are reduced while achieving increased argon production and maintaining the production levels of the medium or high pressure gaseous nitrogen product. Preferably, the flow of the second part or second portion of the boil-off stream from the argon condenser is between about 5.0% and about 12.0% of the flow of the incoming feed air stream.

Alternate embodiments of the present system and method could employ other oxygen containing condensing mediums such as a portion of the high pressure liquid oxygen product stream or the pumped liquid oxygen stream, or even a synthetic kettle stream made up of a mixture of liquid oxygen and liquid nitrogen streams from within the air separation unit.

FIG. 2 depicts a partial schematic diagrams of an alternate embodiment of the present system and method. Many of the features, components and streams associated with the oxygen, nitrogen, and argon producing air separation unit 11 shown in FIG. 2 are similar or identical to those described above with reference to the air separation unit 10 of FIG. 1 and for sake of brevity the description of such components and streams will not be repeated here.

The key differences between the nitrogen producing air separation unit 11 illustrated in FIG. 2 compared to the air separation unit 10 in the embodiment shown in FIG. 1 is the two-stage argon condensing arrangement and the recycle of the boil-off vapor stream 134 from the first stage argon condenser only. The two-stage argon condensing arrangement includes two argon condensers 78A, 78B and the argon-rich vapor stream 126 from the argon column is split into two streams 126A and 126B each going to the argon condensers 78A, 78B, respectively where they are condensed in condenser 78A, the argon-rich vapor stream 126A is condensed against the subcooled kettle stream while the argon-rich vapor stream 126B is condensed against a diverted liquid stream 129 taken from the bottom of argon condenser 78A. The boil-off vapor stream 134 from the first stage argon condenser is recycled to the main air compressor while the boil-off vapor stream 136 from the second stage argon condenser is returned to the lower pressure column.

Examples

A number of computer simulations were run using cryogenic air separation unit operating models to characterize the advantages of recycling the argon condenser vapor stream. The results of the computer simulations are shown in Table 1. Note that the Baseline Case in Table 1 represents a conventional oxygen, nitrogen, and argon producing air separation unit configured for producing a medium or high pressure gaseous nitrogen product stream (i.e. GAN stream). Case 1 and Case 2 represent an oxygen, nitrogen, and argon producing air separation unit in accordance with the embodiment depicted in FIG. 1 whereas Case 3 represents an oxygen, nitrogen, and argon producing air separation unit in accordance with the embodiment shown in FIG. 2.

In Case 1 and Case 2 the vapor recycle stream is a portion of the boil-off stream from the single stage argon condenser (shown in FIG. 1). In Case 1, the flow exiting the main air compressor is approximately the same as the flow exiting the main air compressor in the Baseline Case but with an oxygen concentration of about 22.2% and the gaseous nitrogen product stream or GAN stream is also the same as in the Baseline Case. In Case 2, the gaseous oxygen product stream or GOX stream and GAN stream produced by the air separation unit is approximately the same as the GOX stream and GAN stream produced by the air separation unit in the Baseline Case. In Case 3, the vapor recycle stream was taken from the first stage of the two-stage argon condenser design. This recycle vapor stream is roughly at about 1.93 bar(a) and may be blended into the second stage of the main air compressor, but it also has a lower oxygen concentration than the feed air, resulting in an overall lower oxygen concentration of about 19.1% in the flow exiting the main air compressor.

As seen in Table 1 below, by recycling the argon condenser vapor feed to the main air compressor, one can significantly improve the argon recovery and modestly improve the oxygen recovery while maintaining the production of the gaseous nitrogen product streams compared to a conventional oxygen, nitrogen, and argon producing air separation unit configured for producing the gaseous nitrogen product streams. These computer simulations detail the economic benefits of the argon condenser vapor recycle in terms of higher argon recovery, higher oxygen recovery, and the same or lower total power requirements, while still producing an equal amount of the medium or high pressure gaseous nitrogen product.

TABLE 1

| | | Baseline Case (no vapor recycle) | Case 1 (FIG. 1) (vapor recycle w/same MAC and GAN Flow) | Case 2 (FIG. 1) (vapor recycle w/same GOX and GAN Flow) | Case 3 (FIG. 2) (Ar Cond 1st Stage vapor recycle) |
|---|---|---|---|---|---|
| Incoming Feed Air (Stream 22) | Relative to Baseline | 100% | 94.27% | 96.95% | 96.82% |
| Recycle Vapor Flow (Stream 140) | Relative to Feed Air | 0% | 6.09% | 6.20% | 6.57% |
| MAC Flow (Stream 26) | Relative to Baseline | 100% | 100% | 102.96% | 103.19% |
| Oxygen % in MAC Flow | % | 21.0% | 22.2% | 22.2% | 19.1% |
| Boiler Air (Stream 42) | Relative to MAC Flow | 31.1% | 29.1% | 29.1% | 29.2% |
| Turbine Air (Stream 32) | Relative to MAC Flow | 5.5% | 5.5% | 5.3% | 5.3% |
| Main Air (Stream 40) | Relative to MAC Flow | 63.4% | 65.4% | 65.6% | 65.5% |
| GAN Product (Stream 179) | Relative to Baseline | 100% | 100.00% | 100.00% | 100.00% |
| GOX Product (Stream 195) | Relative to Baseline | 100% | 96.91% | 100.00% | 100.14% |
| Crude Argon (Stream 170) | Relative to Baseline | 100% | 114.42% | 120.23% | 123.04% |
| Clean N2 Shelf (Stream 84) | Relative to Baseline | 100% | 100.00% | 100.00% | 100.00% |
| Power Delta | Relative to Baseline | 100% | 97.84% | 100.70% | 99.65% |
| Oxygen Recovery | % | 95.47% | 98.15% | 98.47% | 98.73% |
| Argon Recovery | % | 59.97% | 71.61% | 73.74% | 75.54% |
| Clean N2 Shelf to GOX Ratio | — | 0.79 | 0.81 | 0.79 | 0.79 |

In Case 1, the argon recovery was enhanced to 71.61% which represents an improvement of over 11 percentage points compared to the Baseline Case and the oxygen recovery was enhanced to 98.15% which represents an improvement of over 2.6 percentage points compared to the Baseline Case. In addition, there was an overall power decrease by virtue of slightly less main air compression power required and less boiler air compression power. However, there was a reduction in total gaseous oxygen (GOX) production by about 3.1% due in part to less incoming feed air.

In Case 2, the argon recovery was enhanced even further to 73.74% which represents an improvement of over 13.7 percentage points compared to the Baseline Case and over 2% compared to Case 1 while the oxygen recovery was also enhanced to 98.47%. In this test Case 2, the total power requirement remained essentially flat as the slight increase in main air compression power required was offset by less boiler air compression power required.

In Case 3, which represents the computer simulation of an oxygen, nitrogen, and argon producing air separation unit having the two-stage argon condensing arrangement as generally depicted in FIG. 2, the argon recovery was enhanced to over 75% which represents an improvement of over 15.5 percentage points compared to the Baseline Case and better than the argon recovery in Case 1 and Case 2. Also, the oxygen recovery was slightly enhanced to 98.73% and the overall power requirement was slightly less than the Baseline Case. Note that in Case 3, the GOX stream and GAN stream produced is approximately the same as the GOX stream and GAN stream produced in the Baseline Case.

Although the present invention has been discussed with reference to one or more preferred embodiments, as would occur to those skilled in the art that numerous changes and omissions can be made without departing from the spirit and scope of the present inventions as set forth in the appended claims.

What is claimed is:

1. An oxygen, argon and nitrogen producing air separation unit configured to receive an incoming feed air stream and produce one or more oxygen product streams one or more nitrogen product streams, and an argon stream, the air separation unit having a main air compression and purification system, a main heat exchanger, and a distillation column system having a higher pressure column and a lower pressure column linked in a heat transfer arrangement via a main condenser-reboiler, an argon column configured for receiving an argon-oxygen containing stream from the lower pressure column, and an argon condensing arrangement configured for condensing an argon-rich vapor stream from the argon column against an oxygen containing condensing medium, the air separation unit characterized by:

a first portion of a boil-off vapor stream exiting the argon condenser is configured to be returned to the lower pressure column; and a second portion of the boil-off vapor stream exiting the argon condenser is configured to be recycled and mixed with the incoming feed air stream.

2. The oxygen, argon and nitrogen producing air separation unit of claim 1, further comprising one or more subcoolers and wherein the oxygen containing condensing medium is a subcooled kettle liquid stream taken from the higher pressure column.

3. The oxygen, argon and nitrogen producing air separation unit of claim 1, wherein the argon condensing arrangement comprises an argon condensing heat exchanger.

4. The oxygen, argon and nitrogen producing air separation unit of claim 1, wherein:

the argon condensing arrangement comprises a first argon condenser configured for condensing a first portion of the argon-rich vapor stream from the argon column against the oxygen containing condensing medium from the higher pressure column or lower pressure column and a second argon condenser configured for condensing a second portion of the argon-rich vapor stream from the argon column against the oxygen containing condensing medium from the higher pressure column or lower pressure column; and wherein the second portion of the boil-off vapor stream to be recycled is a first boil-off vapor stream exiting the first argon condenser and the first portion of the boil-off vapor stream to be returned to the lower pressure column is a second boil-off vapor stream exiting the second argon condenser.

5. The oxygen, argon and nitrogen producing air separation unit of claim 1, wherein the air separation unit further comprises the main heat exchanger and one or more subcoolers and wherein the second portion of the boil-off stream to be recycled is warmed in the main heat exchanger or in the one or more subcoolers or both in the main heat exchanger and in the one or more subcoolers.

6. The oxygen, argon and nitrogen producing air separation unit of claim 1, wherein the flow of the second portion of the boil-off vapor stream is between about 5.0% and about 12.0% of the flow of the incoming feed air stream.

7. The oxygen, argon and nitrogen producing air separation unit of claim 6, wherein the argon recovery from the air separation unit is 70% or more of the argon contained in the incoming feed air stream.

8. The oxygen, argon and nitrogen producing air separation unit of claim 6, wherein the oxygen recovery from the air separation unit is 97% or more of the oxygen contained in the incoming feed air stream.

9. The oxygen, argon and nitrogen producing air separation unit of claim 6, wherein the one or more nitrogen product streams further comprise a gaseous nitrogen product stream taken from the higher pressure column.

10. A method for increasing the argon recovery in an oxygen, nitrogen, and argon producing air separation unit, the air separation unit configured to receive an incoming feed air stream and produce an oxygen product stream, a nitrogen product stream, and an argon stream, the air separation unit having a main air compression circuit, a main heat exchanger, and a distillation column system having a higher pressure column and a lower pressure column linked in a heat transfer arrangement via a main condenser-reboiler, an argon column configured for receiving an argon-oxygen containing stream from the lower pressure column and an argon condensing arrangement configured for condensing an argon-rich vapor stream from the argon column against an oxygen containing condensing medium, the method comprising the steps of:

(a) directing a first portion of a boil-off vapor stream exiting an argon condensing arrangement to the lower pressure column of the distillation column system;

(b) recycling a second portion of the boil-off vapor stream exiting the argon condensing arrangement to the main air compression circuit;

(c) mixing or blending the second portion of the boil-off vapor stream exiting the argon condensing arrangement with the incoming feed air stream;

wherein the recycled second portion of the boil-off vapor stream exiting the argon condensing arrangement is preferably between about 5.0% and about 12.0% of the flow of the incoming feed air stream.

11. The method for increasing the argon recovery in an oxygen, nitrogen, and argon producing air separation unit of claim 10 wherein the argon recovery from the air separation unit is 70% or more of the argon contained in the incoming feed air stream.

12. The method for increasing the argon recovery in an oxygen, nitrogen, and argon producing air separation unit of claim 10 herein the oxygen recovery from the air separation unit is 97% or more of the oxygen contained in the incoming feed air stream.

13. The method for increasing the argon recovery in an oxygen, nitrogen, and argon producing air separation unit of claim 10 the oxygen containing condensing medium is a subcooled kettle liquid stream taken from the higher pressure column.

14. The method for increasing the argon recovery in an oxygen, nitrogen, and argon producing air separation unit of claim 10 wherein the one or more nitrogen product streams further comprise a gaseous nitrogen product stream taken from the higher pressure column.

* * * * *